United States Patent [19]

Gach

[11] Patent Number: 4,682,702

[45] Date of Patent: Jul. 28, 1987

[54] TAMPER INDICATING CLOSURE

[75] Inventor: Peter P. Gach, Evansville, Ind.

[73] Assignee: Sunbeam Plastics Corporation, Evansville, Ind.

[21] Appl. No.: 879,487

[22] Filed: Jun. 27, 1986

[51] Int. Cl.[4] ..... B65D 41/32

[52] U.S. Cl. ..... 215/232; 215/235; 215/254; 220/258; 220/270; 222/541

[58] Field of Search ..... 220/258, 254, 270; 222/541; 215/235, 256, 254, 232

[56] References Cited

U.S. PATENT DOCUMENTS

| | | | |
|---|---|---|---|
| 3,223,298 | 12/1965 | Roberson et al. | 222/541 |
| 3,282,477 | 1/1961 | Henchert | 222/541 |
| 3,419,181 | 12/1968 | Stec | 220/54 |
| 3,434,620 | 3/1969 | Laurizo | 220/27 |
| 3,459,315 | 8/1969 | Labarre | 215/42 |
| 3,483,355 | 12/1969 | Murdock | 220/270 X |
| 3,604,585 | 9/1971 | Towns | 215/235 |
| 3,734,333 | 5/1973 | Foss | 215/46 |
| 4,022,357 | 5/1977 | Dwinell | 222/537 |
| 4,356,939 | 11/1982 | Fitte | 222/541 |
| 4,442,949 | 4/1984 | Dwinell | 220/257 |
| 4,452,382 | 6/1984 | Von Holdt | 222/529 |
| 4,453,646 | 6/1984 | Harrild | 220/258 |
| 4,512,486 | 4/1985 | Kobayashi et al. | 215/249 |

FOREIGN PATENT DOCUMENTS

| | | |
|---|---|---|
| 0553753 | 1/1957 | Belgium . |
| 1126495 | 11/1956 | France . |
| 1217145 | 12/1970 | United Kingdom . |

*Primary Examiner*—Donald F. Norton
*Attorney, Agent, or Firm*—Irvin L. Groh

[57] ABSTRACT

A dispensing closure having a base cap with a top containing a dispensing orifice and a skirt adapted to be attached to a container so that dispensing of the container contents can take place only through the cap orifice. The orifice is sealed with an integrally molded removable disc having a spiral weakening groove which defines a tear strip. Lifting a pull ring attached to the tear strip removes the sealing disc as a spiral strip so that any attempt to hide a previous partial opening by pushing the lifted portion of the strip back in the plane of the disc will be easily detected. A lid attached to the base cap provides easy access to the seal for detecting tampering and removal for use as well as acting to close the orifice after removal of the sealing disc.

16 Claims, 10 Drawing Figures

TAMPER INDICATING CLOSURE

This invention relates to a dispensing closure, and, more particularly, to a tamper indicating dispensing closure which indicates to the observer that the container-closure package has not been opened or that it has been opened or tampered.

There are a wide variety of closures which indicate to a prospective purchaser by the condition of the package whether or not it has been opened or tampered. Often such indication results from the fracture of a component part when the closure cap is unthreaded or snapped off the container.

In the case of a dispensing closure, the cap is designed to be permanently attached to the container or at least not easily removable, so that dispensing must take place through the orifice in the cap and not through the container opening by removable of the cap itself. One way to provide tamper indication is to place a seal member over the dispensing orifice which also serves the useful purpose of sealing the original container. It has been found that tampering of such a sealed container can occur and remain undetected where the person originally opening this seal is careful to pry the seal away from the cap orifice and to replace it in an undamaged state. In order to eliminate the possibility of lifting the entire sealing member, the present invention contemplates the use of a tearing diaphragm type of seal which has been used for a number of years in the canned soft drink field and in the convenience food area on wide mouth containers for nuts and various fancy food products. It is believed that even with the tearing type of diaphragm and that this type of tampering and non-detection could occur even where the sealing member is formed integrally with the cap as a sealing disc which is removed by the upward movement of a seâling ring attached to the disc which breaks the disc along a preweakened line formed by a groove. This is particularly true where the preweakened line only extends around the periphery of the orifice so that the lifted portion of the disc seal can be pushed back into planer alignment with the still attached portion of the sealing disc. Even where an annular tear strip is provided to remove the sealing disc, as in some convenience food, easy opening packages, partial opening could be obscured by careful realignment of the lifted portion with the still attached disc.

It is therefore the primary objective of this invention to provide a dispensing closure having a tamper indicating sealing diaphragm covering the dispensing orifice that will provide ready detection if attempts are made to hide a previous tampering or opening.

The foregoing primary objective of this invention and other advantages are accomplished in a tamper indicating dispensing closure in which a removable sealing membrane or disc is molded integrally with the base cap of the closure to completely seal the dispensing orifice, and must be removed as a spiral tear strip. The closure is constructed with a base cap having a top with a dispensing orifice therein and a depending cylindrical skirt having means for attachment to a container.

Typically, the cap skirt will be internally threaded to engage complementary threads on the container for initial attachment of the closure to the container. An inwardly projecting bead may be formed at the bottom of the cap skirt to co-act with a flange on the container neck so that as the closure is threaded onto the container, the closure bead snaps over the container flange making removal difficult or impossible. Another method of providing rigid attachment of the closure to the container by a mechanical connection is to provide ratchet means on the top of the base cap and the top of the container neck which allows threading of the closure onto the container but prevents unthreading. Other techniques of chemically bonding or gluing the closure cap to the container can be used. Chemical bonding can be employed by supplying the cap with a coated metallic liner disc which is heat fused to both the cap and container after the container has been filled and the closure threaded onto the container. Adhesive substances such as a plastisol liner can be inserted in the base cap to provide a strong adhesion between the cap and container. The base cap may also be firmly attached to the container without threads by coacting snap beads on the container neck and the cap skirt with or without additional gluing or bonding.

The closure is provided with a lid for closing the dispensing orifice, and it is connected to the base cap by a hinge structure which allows the lid to swing from a closed position covering the orifice to an open position for dispensing the contents of the container through the orifice.

The removable sealing disc extends across the orifice below the lid when it is in its closed position. A spiral weakening groove is formed in the face of the disc extending from the periphery inwardly towards the center of the orifice to define, between adjacent turns of the spiral groove, a tear strip. A pull tab is attached to the tear strip adjacent to one end thereof. The pull tab is constructed with a post member attached at one end to the tear strip and having a lifting tab or pull ring at the other end of the post. The sealing disc can be removed as a spiral tear strip by gripping the pull tab and lifting it away from the container. The initial package integrity of the container can be checked by swinging the lid open and observing the condition or absence of the sealing disc.

The presently preferred embodiments of the invention are illustrated in the accompanying drawing in which.

Figure 1:
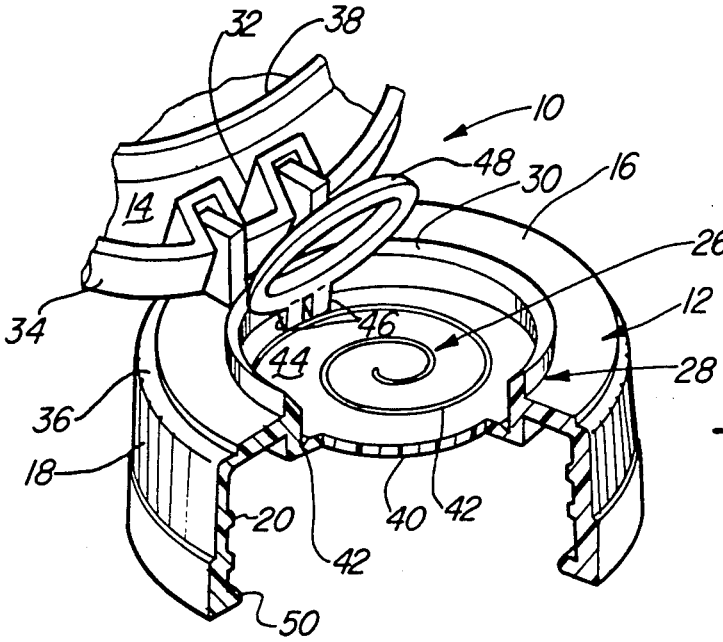
FIG. 1 is a perspective view partially broken away to show the dispensing closure of this invention and the means for attaching it to a container.
Figure 2:
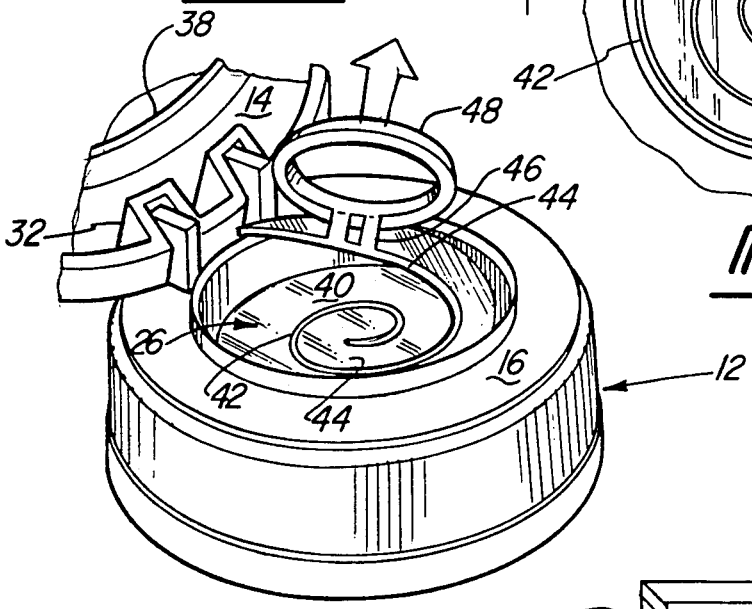
FIG. 2 is a perspective view of the closure similar to FIG. 1 but with the pull tab having been lifted away from the top of the closure to begin the removal of the spiral tear strip.
Figure 5:
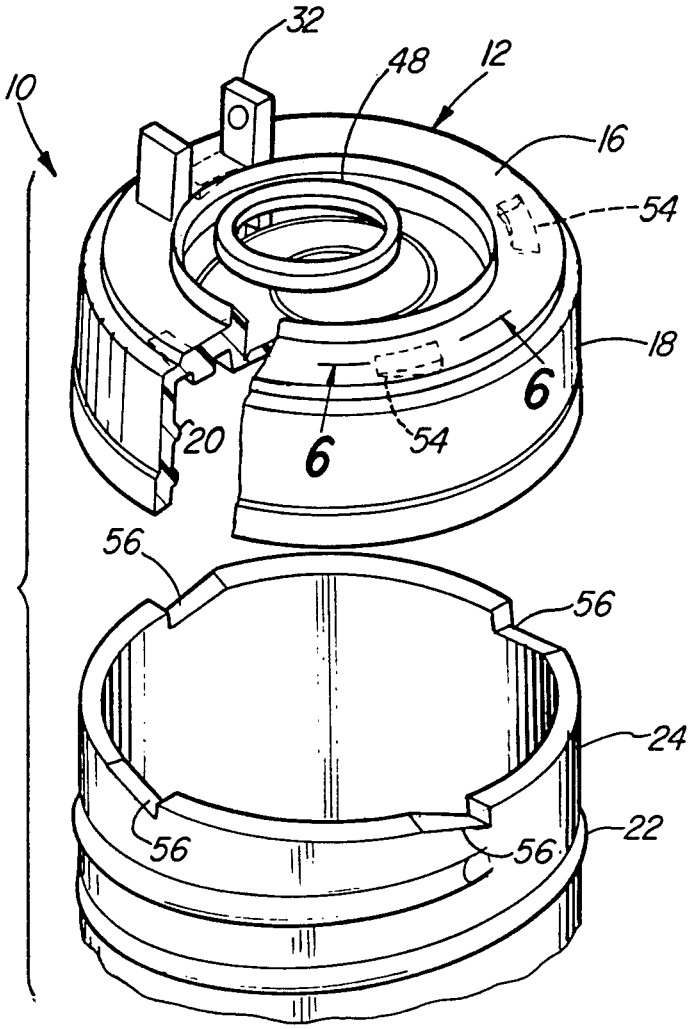
FIG. 5 is an exploded perspective view of the closure arranged to be attached to the container by threads and a ratchet device.

Referring to FIGS. 1 and 5, closure 10 is shown as including two separable parts: base cap 12 and lid 14. Cap 12 is formed with a flat top 16 and a depending annular skirt 18 having internal threads 20 for engaging complementary threads 22 on container neck 24 (FIG. 5).

Cap top 16 has a central circular dispensing orifice 26 which is defined by nozzle collar 28 projecting concentrically with cap skirt 18 above top 16 to define a pouring lip 30.

Base cap 12 and lid 14 are formed with a separable dual post hinge structure 32 as shown and described in U.S. patent application, Ser. No. 825,464 filed in the name of Bush for a TWO PIECE DISPENSING CLOSURE. The lid 14 is further provided with a depending annular skirt 34 the bottom of which engages recess 36 in the top of base cap 12 when the lid is swung to its closed position. Additionally lid 14 is provided with a depending flange or rim 38 which engages the inside or outside diameter of nozzle collar 28 to seal off the dispensing orifice area 26 when the lid is in its closed position.

Figure 3:
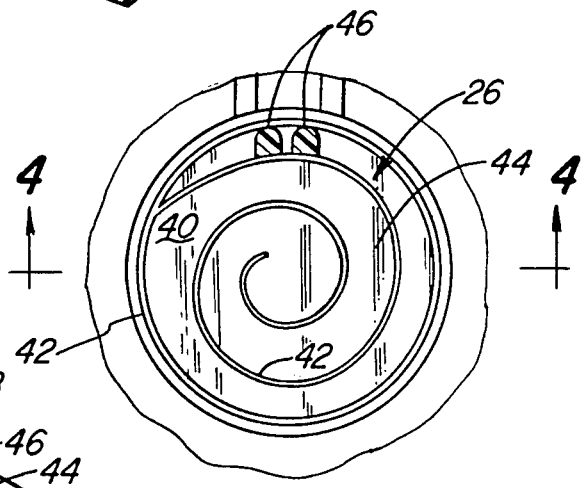
FIG. 3 is a plan view of the closure with the lid removed and the pull tab removed to show the details of the sealing disc with its spiral groove and the attachment posts for the finger grip.
Figure 4:
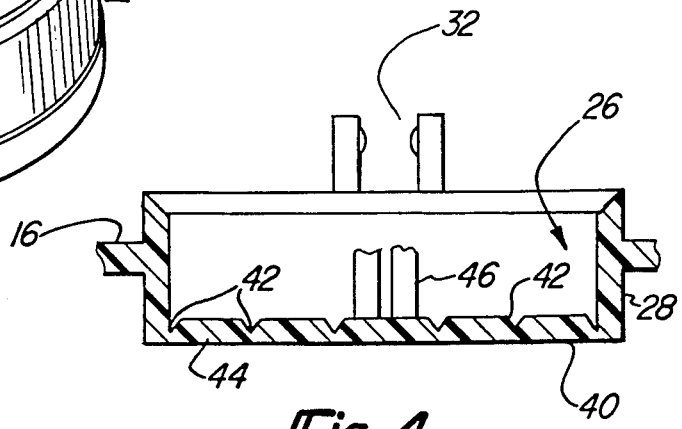
FIG. 4 is a sectional view taken along line 4—4 of FIG. 3 showing the spiral grooves forming the tear stip in the sealing disc.

Molded integrally with the cap 12 is removable sealing disc 40 which is contiguous to the bottom of collar 28 to completely seal the dispensing orifice 26. A spiral weakening groove 42 is formed in the base of the disc extending around the collar 28 inwardly towards the center of the orifice to define between adjacent turns of the spiral groove 42 a tear strip 44. Extending upwardly from the outer area of disc 40 adjacent one end of the tear strip 44 are a pair of posts 46 which are attached to a finger grip or pull ring 48. When the user inserts a finger into the pull ring 48 and pulls upwardly or away from the cap 12, the tear strip will start to separate from the balance of the sealing disc 44 as shown in FIG. 3. The sealing disc 40 will thus be removed as a continuous spiral strip 44, and any attempt to tamper or partially open the dispensing orifice will be easily detected. Once the spiral strip has been lifted free from the disc 40, it will be virtually impossible to hide this prior opening or tampering by pushing the strip back down into collar 28 in an attempt to align the strip with the plane of the disc. The convenience of an easily removed sealing disc has thus been adapted to provide a very reliable indication of tampering of the as packaged product. The perspective customer needs only to swing the lid 14 open to ascertain that no damage and hence no tampering has taken place.

As shown in FIG. 1, the cap skirt 18 is provided with an inwardly projecting bead 50 which coacts with a flange (not shown) on the container neck as the closure 10 is threaded onto the container. The bead 50 snaps over the container flange to retain the closure on the container and prevent its removal.

Figure 6:
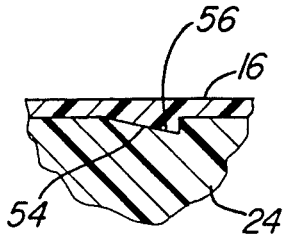
FIG. 6 is a partial cross-sectional view taken along line 6—6 of FIG. 5 showing the inner acting ratchet teeth.

An alternative method of assuring the retention of the closure 10 on the container neck is shown in FIGS. 5 and 6, where ratchet teeth 54 on the inside of cap top 16 are arranged to engage ratchet slots 56 on the top of container neck 24. The teeth 54 will slide over the ratchet recesses 56 when the closure 10 is being threaded onto the container neck 24 but will be retained in the recesses 56 to prevent unthreading of the cap from the container.

Figure 7:
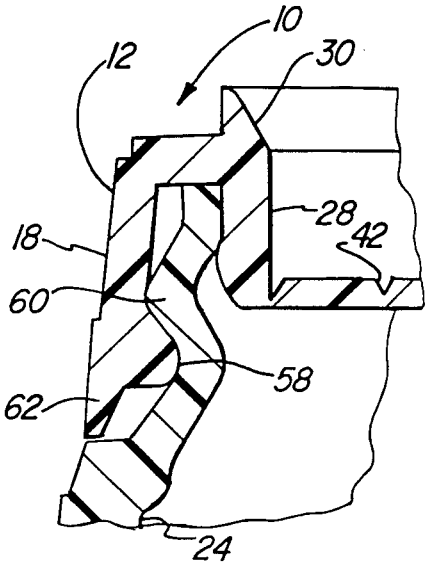
FIG. 7 is a partial elevational view in section showing the closure cap attached to the container by the inner action of a cap bead and container flange.

An alternative method of firmly attaching the closure cap 10 to the container neck 24 is shown in FIG. 7 where an inwardly projecting cap bead 58 is snapped over an outwardly protecting flange 60 on the container neck. This provides a permanent type of seal requiring a different type of capping machine to apply the closure to the container neck than the capping machine that would be used with the threaded closure shown in FIGS. 1 and 5. The extension 62 of the cap skirt 18 beyond the internal bead 58 prevents the use of a prying tool to remove the closure 10 from the container neck.

Figure 9:
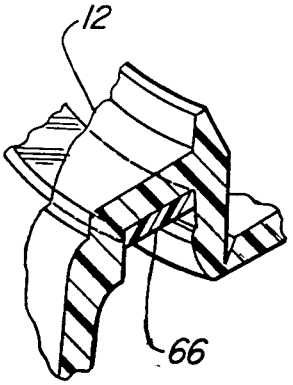
FIG. 9 is a fragmentary perspective view of a portion of the closure shown in FIGS. 7 and 8 showing the use of a metallic seal member for attaching the closure cap to the container.
Figure 8:
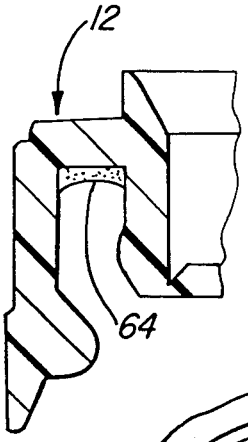
FIG. 8 is a partial elevational view of the closure of FIG. 7 without the container but showing the use of a plastisol liner to rigidly attach the cap to the container.

With any of the foregoing attachment means, or independently thereof, the closure can be glued or permanently bonded to the container neck. The use of a plastisol layer or insert 64 is shown applied to the inside of cap 12 in FIG. 8. The use of an annular metal foil 66 which has been coated on both sides so that it will bond with the cap 12 and container neck 24 when heated after packaging is complete is shown in FIG. 9.

Figure 10:
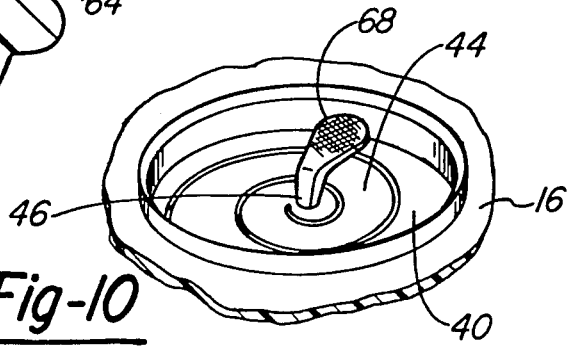
FIG. 10 is a partial perspective view of the top of the closure cap showing an alternative connection of the pull tab to the inside end of the spiral tear strip.

FIG. 10 shows that the spiral tear strip 44 may be separated from the balance of the sealing disc 40 starting at the center by the use of a single post 46 attached to pull tab 68. The placement of the pull tab relative to one or the other ends of the tear strip will be governed by the molding considerations, and the configuration and depth of the spiral groove can be adjusted accordingly.

The embodiments of the invention in which an exclusive property or privilege is claimed are defined as follows:

1. A tamper indicating dispensing closure for use with a container having a neck with means for attachment to said closure comprising, in combination:

a base cap having a top with a dispensing orifice therein and a depending cylindrical skirt having complementary means for attachment to said container;

a lid for closing said dispensing orifice;

a hinge joining said base cap and lid for swinging said lid from a closed position covering said orifice to an open position for dispensing the contents of said container through said orifice; and a removable sealing disc extending across said orifice below said lid in its closed position, said disc including:

a spiral weakening groove in the face of said disc extending from the periphery inwardly towards the center of said orifice to define between adjacent turns of the spiral groove a tear strip; and a pull tab attached to said tear strip adjacent one end thereof;

whereby said sealing disc can be removed as a spiral tear strip by gripping said pull tab and lifting it away from said container, and the initial packaged integrity of the container can be checked by swinging said lid open and observing the condition or absence of said sealing disc.

2. The dispensing closure of claim 1 wherein said pull tab is formed as a post means one end of which is attached to said tear strip and the other of which is attached to a finger grip.

3. The dispensing closure of claim 2 wherein said pull tab is formed integrally with said tear strip.

4. The dispensing closure of claim 3 wherein said sealing disc is formed integrally with said base cap.

5. The dispensing closure of claim 4 wherein said post means includes a pair of closely spaced posts attached at one of their ends to said tear strip and said finger grip is in the form of a pull ring attached to the other end of said posts.

6. The dispensing closure of claim 5 wherein said posts are attached to said tear strip adjacent its outer end.

7. The dispensing closure of claim 2 wherein said post means is attached adjacent the inner end of said tear strip.

8. The dispensing closure of claim 1 wherein said container neck is threaded and said cap skirt is formed with complementary threads for attachment of said closure to said container.

9. The dispensing closure of claim 8 wherein said container is further formed with stop means and said closure is formed with complementary stop means, said stop means cooperating to retain said closure on said container in its fully threaded-on position.

10. The dispensing closure of claim 9 wherein said container stop means includes an outwardly projecting flange on said container neck below said threads and said closure stop means includes an inwardly projecting bead at the bottom of said skirt which snaps over said container flange when said closure is threaded onto said container to retain said closure thereon.

11. The dispensing closure of claim 9 wherein said stop means include ratchet means formed on the top of said base cap and the top of said container neck which allows threading of the closure onto said container but prevents unthreading of the closure from said container.

12. The dispensing closure of claim 1 wherein said container neck is formed with an outwardly projecting flange and said cap skirt is formed with an inwardly projecting bead which snaps over said container flange for attachment of said closure to said container.

13. The dispensing closure of claim 1 wherein said attachment means include a flat lip on said container neck and a complementary annular surface on said closure with an adhesive being applied therebetween.

14. The dispensing closure of claim 1 wherein the container neck has a flat lip, and further comprising an annular metallic seal member disposed within said cap skirt and engaging said lip and said closure when said closure has been initially applied to said container by engagement of said attachment means, said seal member having a coating on one side of a material fusable with said container and a coating on the other side of a material fusable with said closure when said seal members are subjected to heat, whereby said seal member may be fused to said closure and said container to form a permanent connection therebetween.

15. A tamper indicating dispensing closure for use with a container having a neck with means for attachment to said closure comprising, in combination:

a base cap having a top with a dispensing orifice therein and a depending cylindrical skirt having complementary means for attachment to said container;

a lid for closing said dispensing orifice;

a hinge joining said base cap and lid for swinging said lid from a closed position covering said orifice to an open position for dispensing the contents of said container through said orifice;

said base cap being formed with a nozzle collar surrounding said orifice and projecting outwardly from said top and a removable sealing disc molded integrally with said collar closing the lower end thereof to completely seal said orifice;

said disc having a spiral weakening groove in the face thereof extending from the inner periphery of said collar inwardly toward the center of said orifice to define, between adjacent turns of the spiral groove, a tear strip; and a pull tab including post means attached at one end to said tear strip adjacent one end thereof and a finger grip attached to the other end of said post means;

whereby said sealing disc can be removed as a spiral tear strip by gripping said finger grip and lifting it away from said container, and the initial package integrity of the container can be checked by swinging said lid open and observing the condition or absence of said sealing disc.

16. The dispensing closure of claim 15 further including an annular flange on said lid which coacts with said collar to hold said lid in its closed position.

* * * * *